US006906258B2

(12) United States Patent
Hirai et al.

(10) Patent No.: US 6,906,258 B2
(45) Date of Patent: Jun. 14, 2005

(54) ENAMELED WIRE

(75) Inventors: Hisayuki Hirai, Yokohama (JP); Susumu Kojima, Fuchu (JP); Tamon Ozaki, Tokyo (JP); Toshio Shimizu, Tokyo (JP); Takahiro Imai, Tokyo (JP); Hiroki Sekiya, Kanagawa-Ken (JP); Isao Onodera, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/619,522

(22) Filed: Jul. 16, 2003

(65) Prior Publication Data

US 2004/0200636 A1 Oct. 14, 2004

(30) Foreign Application Priority Data

Jul. 17, 2002 (JP) ..... 2002-207950

(51) Int. Cl.[7] ..... H01B 7/34; H01B 7/00

(52) U.S. Cl. ..... 174/36; 174/110 R; 174/120 R

(58) Field of Search ..... 174/125.1, 126.1, 174/127, 36, 110 R, 110 N, 110 D, 116, 120 R, 121 R

(56) References Cited

U.S. PATENT DOCUMENTS

| | | | | | |
|---|---|---|---|---|---|
| 3,668,175 | A | * | 6/1972 | Sattler | 524/176 |
| 3,856,566 | A | * | 12/1974 | Saunders | 427/117 |
| 4,476,192 | A | * | 10/1984 | Imai et al. | 428/391 |
| 4,496,715 | A | * | 1/1985 | Sattler | 528/288 |
| 4,508,779 | A | * | 4/1985 | Miyake et al. | 428/383 |
| 4,716,079 | A | * | 12/1987 | Sano et al. | 428/383 |
| 5,459,286 | A | * | 10/1995 | Bergman et al. | 174/120 R |
| 5,470,657 | A | * | 11/1995 | Hayami | 428/373 |
| 5,654,095 | A | | 8/1997 | Yin et al. | |
| 6,060,162 | A | * | 5/2000 | Yin et al. | 428/372 |
| 6,534,717 | B2 | * | 3/2003 | Suzuki et al. | 174/120 R |
| 6,740,396 | B2 | * | 5/2004 | Carrus et al. | 428/331 |

FOREIGN PATENT DOCUMENTS

| | | | | |
|---|---|---|---|---|
| JP | 10-237237 | A * | 9/1998 | C08L/23/08 |
| JP | 11-126517 | | 5/1999 | |
| JP | 11-130993 | | 5/1999 | |
| JP | 2000-331539 | | 11/2000 | |
| JP | 2001-118428 | | 4/2001 | |
| JP | 2001-307557 | | 11/2001 | |
| JP | 2003-022710 | | 1/2003 | |

* cited by examiner

*Primary Examiner*—William H. Mayo, III
(74) *Attorney, Agent, or Firm*—Oblon, Spivak, McClelland, Maier & Neustadt, P.C.

(57) ABSTRACT

An enameled wire capable of improving withstand lifetime with respect to the application of surge voltage of an inverter and thermal degradation thereof while restricting an amount of an inorganic filler material is provided. The enameled wire includes an electrically conductive wire (11) and a coating (12) formed of a high molecular compound uniformly mixed with an inorganic filler material in the form of fine flat particles provided around the electrically conductive wire (11). The enameled wire may include an electrically conductive wire (21), a coating (23) formed of a polyester imide resin solution mixed with an inorganic filler material in the form of fine flat particles and provided on the conductive wire and a coating (24) formed of polyamide imide and provided on the coating (23).

13 Claims, 3 Drawing Sheets

| | COATING FILM MATERIAL | FILLER MATERIAL | AVERAGE PARTICLE SIZE (nm) | AMOUNT OF ADDITIVE (WEIGHT PART) | MIXING METHOD |
|---|---|---|---|---|---|
| EXAMPLE 1 | PVF | STN | 50 | 0.5 | ATTRITOR |
| EXAMPLE 2 | PVF | STN | 50 | 2.0 | ATTRITOR |
| EXAMPLE 3 | PVF | STN | 50 | 5.0 | ATTRITOR |
| EXAMPLE 4 | PVF | STN | 50 | 5.0 | ROLL |
| EXAMPLE 5 | PVF | STN | 50 | 10.0 | ATTRITOR |
| EXAMPLE 6 | PVF | STN | 50 | 10.0 | ROLL |
| EXAMPLE 7 | PVF | STN | 50 | 20.0 | ATTRITOR |
| EXAMPLE 8 | PVF | STN | 1800 | 5.0 | ATTRITOR |
| EXAMPLE 9 | PVF | STN | 5000 | 5.0 | ATTRITOR |
| EXAMPLE 10 | AI | STN | 50 | 5.0 | ATTRITOR |
| EXAMPLE 11 | EI | STN | 50 | 5.0 | ATTRITOR |
| EXAMPLE 12 | EI/AI | STN | 50 | 5/0 | ATTRITOR |
| EXAMPLE 13 | EI/AI | STN | 50 | 5/3 | ATTRITOR |
| EXAMPLE 14 | EI/AI | STN | 50 | 0/5 | ATTRITOR |
| EXAMPLE 15 | EI | BN | 200 | 5 | ATTRITOR |
| COMPARATIVE EXAMPLE 1 | PVF | – | – | – | – |
| COMPARATIVE EXAMPLE 2 | AI | – | – | – | – |
| COMPARATIVE EXAMPLE 3 | EI | – | – | – | – |
| COMPARATIVE EXAMPLE 4 | EI/AI | – | – | – | – |

(NOTE) PVF : POLYVINYL FORMAL
AI : POLYAMIDE IMIDE
EI : POLYESTER IMIDE
STN,SWN : SYNTHETIC SMECTITE MICA
BN : BORON NITRIDE

FIG. 3

| | FILM THICKNESS (mm) | FLEXIBILITY (WINDING ON ITSELF) | ADHESION | V-t CHARACTERISTIC (min) | THERMAL DEGRADATION CHARACTERISTIC (BVD SURVIVAL PROBABITY /℃·h) |
|---|---|---|---|---|---|
| EXAMPLE 1 | 0.033 | ◎ | ◎ | 50 | - |
| EXAMPLE 2 | 0.033 | ◎ | ◎ | 120 | - |
| EXAMPLE 3 | 0.033 | ◎ | ◎ | 661 | 54/200×168 |
| EXAMPLE 4 | 0.035 | ◎ | ◎ | 4885 | 43/200×168 |
| EXAMPLE 5 | 0.035 | △ | △ | 5600 | - |
| EXAMPLE 6 | 0.033 | ○ | ○ | 28350 | 42/200×168 |
| EXAMPLE 7 | 0.035 | × | × | - | - |
| EXAMPLE 8 | 0.035 | △ | △ | 365 | - |
| EXAMPLE 9 | 0.034 | × | × | - | - |
| EXAMPLE 10 | 0.033 | ◎ | ◎ | 854 | 68/300×168 |
| EXAMPLE 11 | 0.036 | ○ | ○ | >60000 | 64/280×240 |
| EXAMPLE 12 | 0.035 | ◎ | ◎ | >60000 | - |
| EXAMPLE 13 | 0.036 | ◎ | ○ | >60000 | - |
| EXAMPLE 14 | 0.035 | ◎ | ◎ | 6500 | 27/300×48 |
| EXAMPLE 15 | 0.033 | △ | △ | 635 | - |
| COMPARATIVE EXAMPLE 1 | 0.034 | ◎ | ◎ | 38 | 5/200×168 |
| COMPARATIVE EXAMPLE 2 | 0.033 | ◎ | ◎ | 68 | 53/300×168 |
| COMPARATIVE EXAMPLE 3 | 0.036 | ◎ | ◎ | 412 | 47/280×240 |
| COMPARATIVE EXAMPLE 4 | 0.035 | ◎ | ◎ | 365 | 7/300×48 |

(NOTE) EVALUATION WAS MADE ON THE BASIS OF JIS C 3003.

FLEXIBILITY : ENAMELED WIRE WAS WOUND ON ITSELF.

ADHESION : THE MUMBER OF CRACKS OF ENAMELED WIRE SCRATCHED ABRUPTLY BY 20%

V-t CHARACTERESTIC : TIME FROM APPLICATION OF 2KV,10KHz TO STRANDED WIRE TO BREAK DOWN THEREOF.

THERMAL DEGRADATION : SUVIVAL PROBABILITY (%) MEASURED BY BREAK DOWN VOLTAGE OF STRANDED WIRE.
STRANDED WIRE IS THERMALLY DEGRADED IN A FURNACE FOR A PREDETERMINED TIME IN COMPARISON WITH STRANDED WIRE NOT THERMALLY DEGRADED.
TEMPERATURE DEPENDS ON MATERIAL SINCE HEAT-RESISTANCE DEPENDS ON MATERIAL.

FIG. 4

ENAMELED WIRE

BACKGROUND OF THE INVENTION

1. Field of the Invention

The present invention relates to an enameled wire for use in an electric motor, etc.

2. Prior Art

In order to improve the energy efficiency of an electromechanical device having an electric motor, the variable speed control using an inverter is becoming popular. The inverter is usually driven at a frequency in a range from about 2 KHz to several tens of KHz and generates a surge voltage for every, for example, PWM pulse. As is well known, the surge voltage, which is higher than an output voltage of the inverter, depends upon the conditions of the environmental electrical system, for example, cable length and capacitance of the system. If any sine waveform of the surge voltage is sharp, there is a tendency that partial discharges of enameled wire of an electromagnetic device such as a motor occurs. With such partial discharge of the enameled wire, insulating characteristics of the enamel film degrade with increasing speed under the complicated influence of the locally increased temperature of the wire's enamel film and ozone generated by the discharge, resulting in shortening of the life of the electromagnetic equipment.

The durability of enameled wire against surge voltage may be improved to some extent by increasing thickness of the enamel coating film of the enameled wire and/or increasing an amount of resin impregnated in the winding of the motor. In such a case, however, the energy efficiency of the motor is lowered by increased space factor and the cost of the motor is increased. In addition to these problems, there may be cases where desired reliability of the motor can not be obtained. In order to solve these problems, an enamel coating film of an enameled wire has to have superior characteristics against surge voltage of the inverter.

Development of enamel coating film having superior characteristics against inverter surge has been promoted recently. For example, JPH11-126517 of Essex Group Inc., discloses an enameled wire coated with a coating layer containing 10–50 weight % of silica or chromium oxide particles. A catalog of Phelps Dodge, Inc., discloses an enameled wire having a three-layer structure including an intermediate layer called "Quantum Shield Layer" in which metal oxide is mixed.

Further, JP2000-331539 and JP2001-307557, both of which are assigned to Hitachi Cable Ltd., and a technical report of the same company reported in the National Conference of the Electric Engineers of Japan (5-004), 2001, disclose enameled wires each having an enamel coating film in which 30–100 weight parts of fine particles of metal oxide or silica or 3–100 weight parts of sol compound thereof is mixed are disclosed.

As mentioned above, in order to improve the durability of the enameled wire against surge voltage of an inverter of a device using the enameled wire, the enameled wire using an enamel coating film containing inorganic filler material has been developed. In addition, the enamel coating film having a double layer and the enamel coating film having a triple layer structure, each of which contains fine particles of metal oxide or silica as the inorganic filler material, have been proposed. In either of these proposals, the desired characteristics of the enameled wire can not be obtained unless an amount of the inorganic filler material is 30 weight parts or more to 100 weight parts of resin.

SUMMARY OF THE INVENTION

The present invention was made in view of the above mentioned circumstances and has an object to provide an enameled wire, which can improve the withstand lifetime in relation to voltage application and the thermal degradation characteristics against surge voltage of an inverter while restricting an amount of inorganic filler material.

According to a first aspect of the present invention, an enameled wire has an electrical conductor and a coating film layer containing high molecular compound and inorganic filler material in the form of fine flat particles uniformly dispersed in the high molecular compound.

In the enameled wire, the inorganic filler material may be a clay compound having a layer structure.

In this enameled wire, the inorganic filler material may be boron nitride.

The clay compound may include at least one mineral selected from a mineral group consisting of smectites, micas and vermiculites.

The mineral may have metal cation existing between the layers of the layered clay compound substituted by quaternary ammonium salt.

The high molecular compound may be any one of polyvinyl formal, polyester, polyester imide or polyamide imide.

According to a second aspect of the present invention, an enameled wire has an electrical conductor, a first coating film layer surrounding the electric conductor, the coating film being of a high molecular compound of polyester imide resin solution and an inorganic filler material in the form of fine flat plates dispersed in the high molecular compound, and a second coating film of polyamide imide formed on the first coating film layer.

The second coating film of polyamide imide may contain an inorganic filler material in the form of fine flat particles dispersed therein.

According to a third aspect of the present invention, an enameled wire has an electrical conductor, a first coating film layer formed on the conductor, the first coating film layer formed on the first coating film layer and a second coating film layer being formed of a high molecular compound and fine flat particles of polyamide imide.

In any of the first to third aspects of the present invention, the inorganic filler material is a powder having an average particle size not larger than 1 $\mu$m and its compounding ratio is 0.5–15 weight parts to 100 weight parts of the high molecular compound.

BRIEF DESCRIPTION OF THE DRAWINGS

FIG. 3 is a table showing constituents of various embodiments of the enameled wire according to the present invention and those of comparative examples and mixing methods thereof; and FIG. 4 is a table showing an evaluation based on characteristics tests of the embodiments and the comparative examples shown in the table in FIG. 3.

DETAILED DESCRIPTION OF THE PREFERRED EMBODIMENTS

Figure 1:
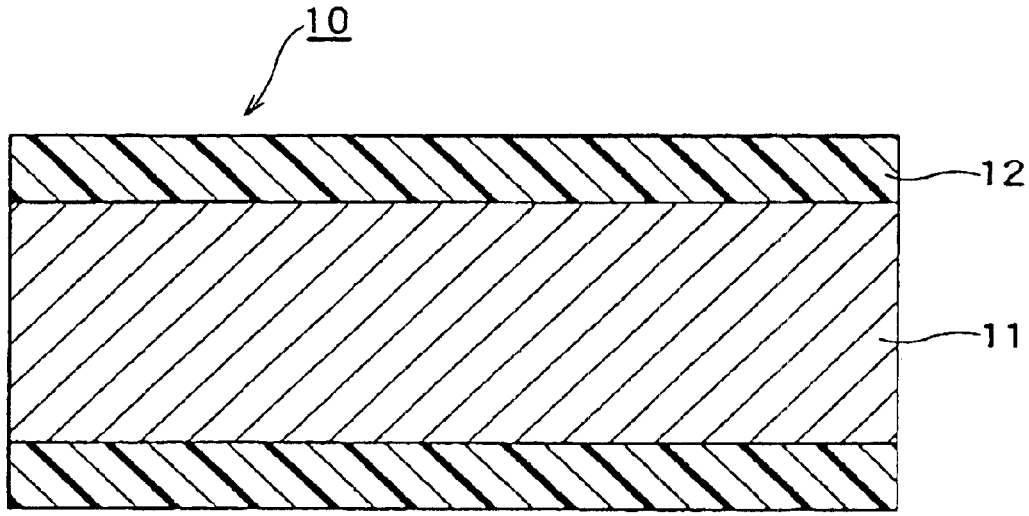
FIG. 1 is a longitudinally cross sectional view of an enameled wire according to a first embodiment of the present invention.

Now, the present invention will be described in detail with reference to preferred embodiments shown in the drawings.

FIG. 1 is a longitudinally cross sectional view of an enameled wire according to a first embodiment of the present invention. In FIG. 1, the enameled wire generally depicted by a reference number 10 includes a conductor 11 formed by an electrically conductive wire and an enamel coating film 12 painted on a surface of the conductor 11. The enamel coating film 12 is formed of a high molecular compound and an inorganic filler material in the shape of fine flat particles uniformly dispersed in the high molecular compound. The enamel coating film 12 will be described in more detail.

In order to improve the V-t characteristics (withstand lifetime characteristics in relation to voltage application) and the thermal degradation characteristics of an enameled wire having an enamel coating resin containing an inorganic filler material in the shape of fine flat particles dispersed therein, it is important that the inorganic filler material is uniformly mixed densely in the coating resin without defects such as voids by making the shape of the fine particle of the inorganic filler material and the wettability thereof for the enamel resin adequate.

In this embodiment, in order to give a layer structure to the inorganic filler material layer, the mixing method employed in the present invention is to mix the inorganic filler material into the high molecular compound while peeling off layers of the inorganic filler material by applying shearing force thereto during stirring with the compound. In mixing the inorganic filler material into the high molecular compound, an attritor (Union Process Inc. of USA) was used mainly. The enamel resin of high molecular compound, the inorganic filler material and balls called "media" are put in a stirring vessel of the attritor and stirred by collision, shearing and abrasion, etc., when a stirring arm of the attritor is rotated. In some cases, a three-roll mill was used.

On the other hand, in producing the enameled wire, the high molecular compound is applied to a surface of the conductor, which is washed, by passing it through the high molecular compound solution in a resin tank. The amount of high molecular compound applied to the surface is regulated by passing the conductor having the high molecular compound thereon through a die having a predetermined size and then the resin on the conductor is hardened in a furnace. The thickness of the resin is regulated to a predetermined value by repeating the above process a plurality of times, resulting in the enameled wire. The resin thickness obtainable by one process is usually several microns.

Therefore, according to this embodiment, a substantial portion of the inorganic filler material is aligned in parallel to the surface of the conductor since the thickness of the resin formed on the conductor surface at one time is several microns and the inorganic filler material takes the form of fine flat particles. Consequently, partial discharge caused by the sharp surge voltage of an inverter is applied in a surface direction of the inorganic filler material and, therefore, degradation of the speed of the enamel coating film is low and it is possible to increase the with stand life time in relation to voltage application. On the other hand, the thermal degradation of the high molecular compound progresses by thermal decomposition and oxidation due to diffusion of oxygen in the high molecular compound. Since the diffusion of oxygen is delayed by the orientation of the flat inorganic filler particles as mentioned above, the oxygen degradation is restricted and the resistance for the thermal degradation of the enameled wire can be improved.

As the high molecular compound, polyvinyl formal (PVF), polyester (PE), polyester imide (EI), polyamide imide (AI) or polyimide (PI), etc., may be used. By using these materials, it is possible to improve partial discharge durability and heat-resistance of the enameled wire.

The inorganic filler material is a clay compound having layer structure and contains at least one mineral selected from a mineral group consisting of smectites, micas and vermiculites. For example, the smectites include montmorillonite, hectorite, saponite, sauconite, beidellite, stevensite, nontronite, etc. The micas include chlorite, phlogopite, lepidolite, muscovite, biotite, palagonite, margarite, taeniolite, tetrasilicicmica, etc. Thevermulites includes trioctahedral vermiculite and dioctahedral vermiculite, etc.

The clay compound has a layer structure including laminated silicate layers, which are hardly peeled off and can not be uniformly dispersed in the high molecular compound by a mere stirring. Therefore, it is preferable that the stirring for uniformly mixing the clay compound in the high molecular compound is performed by using the ball mill, attritor and/or the roll mill.

By using the high molecular compound with the inorganic filler material uniformly dispersed therein as the enamel coating of the conductor, the partial discharge resistance and the thermal durability of the enameled wire can be improved.

In such a case, the particle size of the inorganic filler material to be added to the high molecular compound is preferably not larger than 1 $\mu$m and, more preferably, not larger than 0.1 $\mu$m. When the particle size of the inorganic filler material is large, the surface smoothness and the stretching characteristics of the enamel coating layer of the enameled wire may be degraded. The compounding ratio of the inorganic filler material is 0.5–15 weight parts, preferably, 1–10 weight parts to 100 weight parts of the high molecular compound. Since the inorganic filler material takes the form of fine flat particles, a considerable effect can be realized by even a small amount of the inorganic filler material.

Incidentally, the clay compound has the layer structure in which the silicate layers and adjacent layers thereof are bonded together by metal cation. By substituting the metal cation by other substance, it is possible to improve affinity between the high molecular compound and the inorganic filler material and to improve the layer peeling characteristics and the dispersion characteristics of the inorganic filler material during the stirring. As the substituting substance for the metal cation, any one of various quaternary ammonium salts is preferable.

Boron nitride (BN) may be used as the inorganic filler material to be mixed in the high molecular compound. In such a case, since the dielectric constant of the enamel coating layer is lowered thereby, the electric field is relaxed, so that a voltage at which the partial discharge occurs can be increased. Further, since thermal conductivity of the enamel coating layer is improved thereby, temperature of a portion of the enamel coating layer, at which the partial discharge occurred, can be lowered by diffusing heat caused by partial discharge.

As mentioned, according to the first embodiment of the present invention, it is possible to improve the withstand lifetime in relation to voltage application of the enameled wire for surge voltage of the inverter and the thermal degradation characteristics of the enameled wire, while restricting the amount of the inorganic filler material to a low value.

Figure 2:
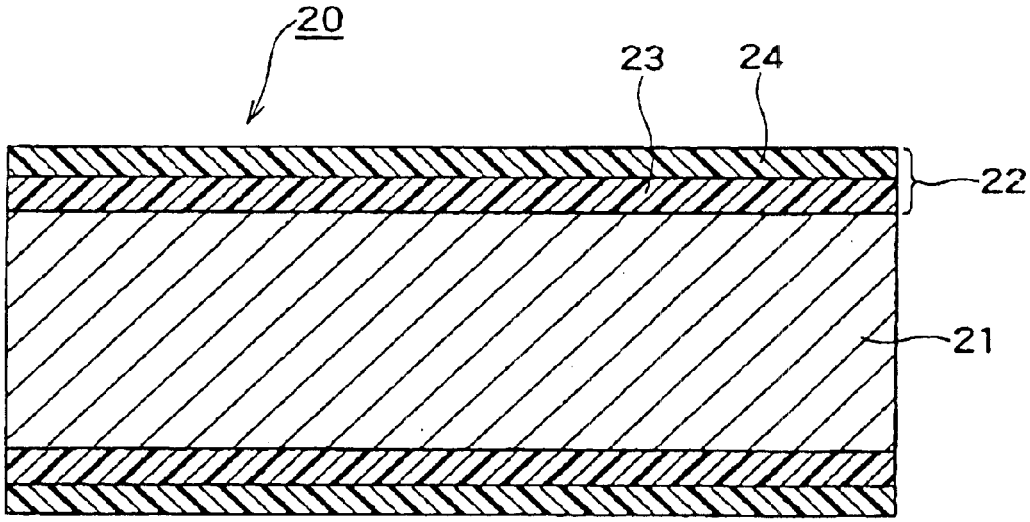
FIG. 2 is a longitudinally cross sectional view of an enameled wire according to a second embodiment of the present invention.

FIG. 2 is a longitudinally cross sectional view of an enameled wire according to a second embodiment of the present invention. In FIG. 2, an enameled wire 20 includes a conductor 21 and an enamel coating film 22 painted on a surface of the conductor. The enamel coating film 22 is constructed with a first coating layer 23 directly formed on the conductor 21 and a second coating layer 24 formed on the first coating layer 23. The first coating layer 23 is formed by coating the conductor 21 with polyester imide (EI) resin solution mixed with fine flat inorganic filler particles uniformly dispersed therein and the second coating layer 24 is formed by coating the first coating layer 23 with polyamide imide (AI).

According to this construction of the enamel coating layer, the polyester imide layer as the first coating layer 23 contributes to improvements of the partial discharge resistance and the thermal durability of the enameled wire. The polyamide imide layer as the second coating layer 24 has good stretching and slipping characteristics. Therefore, the enameled wire is hardly damaged in winding and has superior workability.

Further, it is possible to uniformly mix fine flat particles of the inorganic filler material in the polyamide imide layer as the second coating layer 24. In such a case, the stretching and slipping characteristics of the enameled wire can be maintained by making an amount of the inorganic filler material of the second coating layer 24 smaller than the amount of the inorganic filler material of the first coating layer 23. According to the enamel coating film 22, the partial discharge resistance of the enameled wire for surge voltage and the thermal durability of the enameled wire can be improved.

Alternatively, the first coating layer 23 may be formed of polyester imide resin without inorganic filler material and the second coating layer 24 is formed of polyamide imide resin with fine flat particles of the inorganic filler material.

With such double layer structure having the first coating layer 23 formed of polyester imide resin without inorganic filler material and the second coating layer 24 formed of polyamide imide resin with fine flat particles of the inorganic filler material, the partial discharge resistance of the enameled wire for surge voltage and the thermal durability of the enameled wire can be improved too.

According to the second embodiment of the present invention, it is possible to improve the withstand lifetime for surge voltage application and the thermal degradation characteristics by making an amount of the inorganic filler material of the second coating layer smaller than the amount of the inorganic filler material of the first coating layer.

Incidentally, in the first and second embodiments, the inorganic filler material takes the form of powder of fine flat particles having average particle size not larger than 1 $\mu$m and the surface smoothness and the stretching characteristics of the enamel coating are improved by adding 0.5–15 weight parts of the inorganic filler material to 100 weight parts of the high molecular compound. Further, the described effects can be achieved while restricting the amount of the inorganic filler material.

Further, it is possible to use a coupling agent and a dispersing additive in mixing the inorganic filler material in the high molecular compound. Further, it is possible to paint an outermost surface of the enameled wire with paraffin or nylon (brand name), etc., to provide a lubricating coat on the enameled wire.

Now, concrete embodiments (Embodiments 1 to 15) of the enameled wire having the first and second coating layers, according to the present invention, will be described in comparison with Comparative Examples 1 to 4. The Embodiments 1 to 15 were prepared by changing the kind of coating material, the kind of inorganic filler material in the form of fine flat particles, the average size of the inorganic filler particle, the amount of the filler material and the mixing method of the enamel coating film 12 in the table shown in FIG. 3. Four conventional enameled wires having different coatings were prepared as the Comparative Examples 1 to 4, as shown in the table in FIG. 3. These Embodiments and Comparative Examples were tested according to Japanese Industrial Standards (JIS). The Embodiments and the Comparative Examples will be described in detail.

First, as described previously, in order to improve the V-t characteristics (withstand lifetime characteristics in relation to voltage application) and the thermal degradation characteristics of an enameled wire having an enamel coating resin containing inorganic filler material dispersed therein, it is important that the inorganic filler material is uniformly mixed in the coating resin without defects such as voids by making the shape of the fine flat particles of the inorganic filler material and wettability thereof for the enamel resin adequate.

In these Embodiments 1 to 15 and Comparative Examples 1 to 4, since the inorganic filler material layer has the layer structure, the mixing method employed provides layer peeling to the filler material by applying shearing force thereto during stirring with the resin is employed. In mixing, an attritor (Union Process Inc. of USA) was used mainly. The enamel resin, the inorganic filler material and balls called "media" are put in a stirring vessel of the attritor and stirred through collision, shearing and abrasion, etc., when a stirring arm of the attritor is rotated. In some cases, the three-roll mill was used.

A conductor was painted with paint obtained by uniformly mixing a predetermined amount of inorganic filler material into a high molecular compound, and then the conductor was baked in a baking furnace. Throughout the Embodiments and the Comparative Examples, the conductor was a copper wire having diameter of 1.0 mm. By changing the thickness of the enamel coating layer, the flexibility, the adhesion, the V-t characteristics and the thermal degradation characteristics of the enameled wire were tested and evaluated. FIG. 4 is a table showing a result of the evaluation. In this case, the tests were performed according to JIS C3003, basically.

The flexibility was tested on the number of cracks produced when the original enameled wire is wound on a rod having the same diameter as that of the enameled wire and the number of cracks when the enameled wire after being stretched by 10% is wound on itself. In FIG. 4, mark ⊙ in the flexibility column indicates no cracks in either enameled wires, mark o indicates 5 cracks or less in only the case when the enameled wire, after being stretched by 10%, is wound on itself and mark Δ indicates cracks in only the case when the enameled wire, after being stretched by 10%, is wound. Mark x in the flexibility column indicates a case where there are cracks occurring when the enameled wire, which is not stretched, is wound on itself. The adhesion was evaluated on the basis of cracks occurred when the enameled wire is abruptly stretched by 20% and mark ⊙ in the adhesion column indicates no cracks, mark o indicates 3 cracks or less, mark Δ indicates 10 cracks or less and mark x in the adhesion column indicates 10 cracks or more. The V-t characteristics were evaluated by time (in minute) measured from a time instance at which a voltage 2 KV, 10 KHz is applied to a stranded enameled wire to a time at which the wire is broken down. The thermal degradation characteristics were evaluated by survival probability (%) of the enameled wire, which is obtained by comparing the breakdown voltage of the stranded enameled wire, which is thermally degraded in a thermoregulator at a predetermined temperature, measured at a room temperature with that of the stranded enameled wire before being thermally degraded. Since the thermal degradation characteristics depend upon the kind of material of the enamel coating layer of the enameled wire, the predetermined temperature of the thermoregulator is not constant. The evaluation result will be considered with reference to the table shown in FIG. 4.

COMPARATIVE EXAMPLE 1

Usual enameled wires each having a formal coating layer 34 μm thick were used. The V-t characteristic was 38 minutes and the ratio of the residual breakdown voltage of the wire degraded at 200° C. for 168 hours was 5%.

COMPARATIVE EXAMPLE 2

Polyamide imide wires each having a formal coating layer 33 μm thick were used. The V-t characteristic was 68 minutes and the ratio of the residual breakdown voltage of the enameled wire degraded at 300° C. for 168 hours was 53%.

COMPARATIVE EXAMPLE 3

Polyester imide wires each having a formal coating layer 36 μm thick were used. The V-t characteristic was 412 minutes and the ratio of the residual breakdown voltage of the wire degraded at 280° C. for 168 hours was 47%.

COMPARATIVE EXAMPLE 4

Double coating wires each including an inner layer of polyester imide 30 μm thick and an outer layer of polyamide imide 5 μm thick were used. The V-t characteristic was 365 minutes and the ratio of the residual breakdown voltage of the wire degraded at 300° C. for 48 hours was 7%.

The flexibility and adhesion characteristics of all of the above mentioned Comparative Examples were good.

Embodiment 1

In the Embodiment 1 of the present invention, 0.5 weight parts of synthetic smectite STN having average particle size of 50 nm and fabricated by Cope Chemical K.K. was added as the inorganic filler material to a formal resin solution as the high molecular compound and the mixture was stirred by an attritor for 6 hours at rotation speed of 300 revolutions/minute. A conductor having diameter of 1 mm was painted with the stirred mixture and baked to form the coating layer 33 μm thick. The flexibility characteristics and the adhesion characteristics were good and the V-t characteristic was 50 minutes, showing an improvement of 30% compared with the Comparative Example 1.

Embodiment 2

In the similar manner to the Embodiment 1, 2 weight parts of synthetic smectite STN was added to a formal resin solution, the mixture was stirred and the coating layer 33 μm thick was formed by painting the conductor with the stirred mixture and baking it. The flexibility characteristics and the adhesion characteristics were good, and the V-t characteristic was 120 minutes, showing an improvement of three times that of the Comparative Example 1.

Embodiment 3

In the similar manner to the Embodiment 1, 5 weight parts of synthetic smectite STN was added to a formal resin solution, the mixture was stirred, the coating layer 33 μm thick was formed by painting the conductor with the mixture and baking. The flexibility characteristics and the adhesion characteristics were good and the V-t characteristic was 661 minutes, showing an improvement of 17 times that of the Comparative Example 1. As to the thermal degradation, the ratio of the residual breakdown voltage of the wire degraded at 200° C. for 168 hours was 54%, showing substantial improvement compared with the Comparative Example 3.

Embodiment 4

In the similar manner to the Embodiment 1, 5 weight parts of the inorganic filler material was added to the resin solution, the mixture was milled 5 times by using three-roll mill each having a diameter of 20 cm, and the coating layer 33 μm thick was formed by painting the conductor with it. The flexibility characteristics and the adhesion characteristics were good, and the V-t characteristic was 4885 minutes, showing an improvement of about 128 times that of the Comparative Example 1. As to the thermal degradation, the ratio of the residual breakdown voltage of the wire degraded at 200° C. for 168 hours was 43%, showing substantial improvement. Although the milling system is different from that used in the Embodiment 3 while the amount of the inorganic filler material is the same, the V-t characteristic was about 7 times that of the Embodiment 3 because the shearing force of the roll mill is high enough to efficiently peel layers of the inorganic filler material having the layer structure efficiently.

Embodiment 5

In the similar manner to the Embodiment 1, 10 weight parts of the inorganic filler material was added to the resin solution, and the coating layer 35 μm thick was formed. The enamel coating layer was cracked, showing a clear degradation of the flexibility characteristics and the adhesion characteristics. The V-t characteristic was 5600 minutes, showing an improvement of about 147 times that of the Comparative Example 1.

Embodiment 6

In a similar manner to the Embodiment 1, 10 weight parts of the inorganic filler material was added to the resin solution and the coating layer 33 μm thick was formed. There were small cracks, showing the flexibility characteristics and the adhesion characteristics of the enameled wire were not so good. The V-t characteristic was 8350 minutes, showing an improvement of about 746 times that of the Comparative Example 1 and about 5 times compared with the Embodiment 5 using the same amount of inorganic filler material. As to the thermal degradation, the ratio of the residual breakdown voltage of the wire degraded at 200° C. for 168 hours was 42%, showing substantial improvement.

Embodiment 7

In the similar manner to the Embodiment 1, 20 weight parts of the inorganic filler material was added to the resin solution and the coating layer 35 μm thick was formed. The outer appearance of the enameled wire was dull and many cracks were found, showing substantial degradation of both the flexibility and the adhesion.

Embodiment 8

In the Embodiment 8, 5 weight parts of smectite SWN having average particle size of 1.8 μm was added to 100 weight parts of formal resin solution, the mixture was stirred by the attritor for 6 hours, and the coating layer 35 μm thick was formed. There were cracks in the coating layer, showing a clear degradation of the flexibility characteristics and the adhesion. The V-t characteristic was 365 minutes, which is the worst in the Embodiments using 5 weight parts of the inorganic filler material. This shows that, when the particle size is large, itis impossible to obtain good characteristics of the enameled wire having a plurality of coating layers each having about 5 μm thick painted on the conductor.

Embodiment 9

In the Embodiment 9, 5 weight parts of smectite SWN having average particle size of 5 μm was added to 100 weight parts of formal resin solution, the mixture was stirred by the attritor for 6 hours and the coating layer 34 μm thick was formed. There were cracks in the coating layer, showing a clear degradation of the flexibility characteristics and the adhesion.

Embodiment 10

In the Embodiment 10, 5 weight parts of smectite STN having average particle size of 5 μm was added to 100 weight parts of a polyamide imide resin solution, the mixture was stirred by the attritor for 6 hours and the coating layer 33 μm thick was formed. The flexibility characteristics and the adhesion were good, and the V-t characteristic was 854 minutes, showing an improvement of about 12 times compared with the Comparative Example 2. The ratio of the residual breakdown voltage of the enameled wire degraded at 300° C. for 168 hours was 68%, showing substantial improvement of the thermal degradation compared with the Comparative Example 2.

Embodiment 11

In the Embodiment 11, 5 weight parts of smectite STN was added to 100 weight parts of polyester imide resin solution, the mixture was stirred by the attritor for 6 hours and the coating layer 36 μm thick was formed. There were some cracks, showing slight degradation of the flexibility characteristics and the adhesion characteristics. The V-t characteristic was 60000 minutes or longer, showing superior V-t characteristics. The ratio of the residual breakdown voltage of the enameled wire degraded at 280° C. for 240 hours was 64%, showing substantial improvement of the thermal degradation compared with the Comparative Example 3.

Embodiment 12

In the Embodiment 12, 5 weight parts of smectite STN was added to 100 weight parts of polyester imide resin solution, the mixture was stirred by the attritor for 6 hours and the coating layer 30 μm thick was formed. By painting the coating layer with polyamide imide having no additive to form an upper layer 5 μm thick, a double coating enameled wire was obtained. The flexibility characteristics and the adhesion characteristics were good. The polyamide imide layer may restrict cracking. The V-t characteristic was 60000 minutes or longer, showing superior V-t characteristics.

Embodiment 13

In the Embodiment 13, 5 weight parts of smectite STN was added to 100 weight parts of polyester imide resin solution, the mixture was stirred by the attritor for 6 hours and the coating layer 30 μm thick was formed. By painting the coating layer with polyamide imide mixed with 3 weight parts of smectite STN to form an upper layer 5 μm thick, a double coating enameled wire was obtained. Although the flexibility characteristic was good, the adhesion characteristic was slightly degraded. The V-t characteristic was 60000 minutes or longer, showing superior V-t characteristics.

Embodiment 14

Double coating wires each including an inner layer 25 μm thick of polyester imide and an outer layer 10 μm thick of polyamide imide mixed with 5 weight parts of smectite STN were used. The flexibility and the adhesion were good and the V-t characteristic was 6500 minutes, which is about 18 times that of the comparative example 4. The ratio of the residual breakdown voltage of the wire degraded at 300° C. for 48 hours was 27%, superior to that of the Comparative Example 4.

Embodiment 15

Enamel paint was prepared by mixing 5 weight parts of boron nitride "FS" of a product of Mizushima Gokintetsu K.K. to 100 weight parts of polyester imide resin solution and stirring by an attritor at rotation speed of 250 revolutions/minute for 6 hours. An enamel coating layer was formed on a conductor having diameter of 1 mm by painting and baking. The partial discharge starting voltage for the stranded enameled wire at 50 Hz was 650V and the partial discharge extinction voltage was 520V, which were slightly better than the respective 600V and 430V of the comparative example 3, respectively. The V-t characteristic was about 1.5 times.

In the described embodiments, the V-t characteristic of the enameled wire was substantially improved by mixing boron nitride or clay compound having layer structure, as the inorganic filler material in the form of fine flat particles into the high molecular compound. Particularly, when the inorganic filler material is mixed with polyester imide as the high molecular compound, the characteristics of the enameled wire become superior. Further, the thermal degradation characteristic of the enameled wire, which is evaluated by the ratio of the residual breakdown voltage, can be substantially improved since the flat inorganic filler particles restrict oxygen diffusion in the enamel layer.

Incidentally, when minerals such as mica or vermiculite are used in lieu of smectite, substantially the same withstand voltage and the thermal degradation characteristics as those obtainable by smectite can be obtained.

As described hereinbefore, it is possible, according to the present invention, which features the enameled wire having the enamel layer containing inorganic fine particles, to substantially improve the V-t characteristics and the thermal degradation characteristics of the enameled wire. Therefore, the enameled wire according to the present invention is especially suitable for use in, particularly, such as electric motor or an electronic device, which has an inverter and is influenced by surge voltage thereof.

What is claimed is:

1. An enameled wire comprising an electrically conductive wire and a coating layer surrounding the wire, wherein the coating layer comprises a high molecular compound, and an inorganic filler material in the form of fine flat particles aligned parallel to the surface of the wire and uniformly dispersed in the high molecular compound.

2. An enameled wire as claimed in claim 1, wherein the inorganic filler material is a clay compound having a layer structure.

3. An enameled wire as claimed in claim 2, wherein the clay compound having a layer structure includes at least one mineral selected from the group consisting of smectites, micas and vermiculites.

4. An enameled wire as claimed in claim 3, wherein a metal cation existing between adjacent layers of the clay compound is substituted by a quaternary ammonium salt.

5. An enameled wire as claimed in claim 1, wherein the inorganic filler material is boron nitride.

6. An enameled wire as claimed in claim 1, wherein the high molecular compound is one of polyvinyl formal, polyester, polyester imide and polyamide imide.

7. An enameled wire as claimed in any one of claims 1 to 6, wherein the inorganic filler material has an average particle size of 1 $\mu$m or less; and the coating layer comprises 0.5 to 15 weight parts of the inorganic filler material relative to 100 weight parts of the high molecular compound.

8. A method of making an enameled wire, the method comprising coating on an electrically conductive wire a mixture containing a high molecular compound and an inorganic filler material; and producing the wire of claim 1.

9. An enameled wire comprising an electrically conductive wire;

a first coating layer surrounding the wire, where the first coating layer comprises a high molecular compound comprising polyester imide resin, and an inorganic filler material in the form of fine flat particles aligned parallel to the surface of the wire and uniformly dispersed in the high molecular compound; and a second coating layer comprising polyamide imide on the first coating layer.

10. An enameled wire as claimed in claim 9, wherein the second coating layer comprises a dispersed inorganic filler material in the form of fine flat particles.

11. An enameled wire as claimed in claim 9 or 10 wherein the inorganic filler material has an average particle size of 1 $\mu$m or less; and the first coating layer comprises 0.5 to 15 weight parts of the inorganic filler material relative to 100 weight parts of the polyamide imide resin of the first coating layer.

12. An enameled wire comprising an electrically conductive wire a first coating layer on the wire, where the first coating layer comprises a polyester imide resin; and a second coating layer on the first coating layer, where the second coating layer comprises polyamide imide, and an inorganic filler material in the form of fine flat particles aligned parallel to the surface of the wire and uniformly dispersed in the polyamide imide of the second coating layer.

13. An enameled wire as claimed in claim 12, wherein the inorganic filler material has an average particle size of 1 $\mu$m or less; and the second coating layer comprises 0.5 to 15 weight parts of the inorganic filler material relative to 100 weight parts of the polyamide imide of the second coating layer.

* * * * *